United States Patent [19]

Chesnel

[11] 4,079,324

[45] Mar. 14, 1978

[54] PULSE TRANSFORMER, PARTICULARLY FOR LOW-IMPEDANCE MODULATORS

[75] Inventor: André Chesnel, Paris, France

[73] Assignee: Thomson-CSF, Paris, France

[21] Appl. No.: 722,088

[22] Filed: Sep. 10, 1976

[30] Foreign Application Priority Data

Sep. 11, 1975 France ..... 75 27327

[51] Int. Cl.[2] ..... H01F 15/14; H01F 27/28

[52] U.S. Cl. ..... 328/104; 336/70; 336/223

[58] Field of Search ..... 336/69, 70, 180, 181, 336/182, 184, 222, 223, 195; 328/67, 104

[56] References Cited

U.S. PATENT DOCUMENTS

| | | | |
|---|---|---|---|
| 719,005 | 1/1903 | Hogg | 336/69 |
| 3,264,592 | 8/1966 | Pearson | 336/70 |
| 3,590,279 | 6/1971 | Thompson et al. | 328/67 X |
| 3,737,679 | 6/1973 | Cooper | 328/67 |
| 3,849,732 | 11/1974 | Pezot | 328/67 |

FOREIGN PATENT DOCUMENTS

| | | | |
|---|---|---|---|
| 1,220,031 | 6/1966 | Germany | 336/182 |
| 500,775 | 2/1939 | United Kingdom | 336/70 |
| 891,006 | 3/1962 | United Kingdom | 336/70 |

*Primary Examiner*—Thomas J. Kozma
*Attorney, Agent, or Firm*—Karl F. Ross

[57] ABSTRACT

A transformer for high-power pulses, inserted between a plurality of parallel-connected low-impedance power-modulator modules and a load, has a composite primary winding formed from an outer and an inner prismatic sheet-metal layer of five and three turns, respectively, conductively interconnected at the top and provided with respective terminal tabs at the bottom. The layers are so wound that their magnetic fluxes, induced in a core surrounded by the winding, oppose each other to give the effect of a single-layer two-turn winding, yet with elimination of the spacing between the terminals otherwise necessary and of the corresponding parasitic impedance.

7 Claims, 6 Drawing Figures

PULSE TRANSFORMER, PARTICULARLY FOR LOW-IMPEDANCE MODULATORS

FIELD OF THE INVENTION

The present invention relates to pulse transformers and more particularly those which are associated with low impedance modulators.

BACKGROUND OF THE INVENTION

Pulse transformers which are associated with the power modulators of radar equipment, for example, need to have a wide pass-band in order to allow high-power pulses to pass without distorting them to an excessive degree. The fact is that, at high frequencies, owing to the leakage inductance and the stray capacitance of the windings, the leading edge of the pulse tends to lose its steepness and to diverge from the ideal shape for a pulse edge. On the other hand, the low frequencies in the band are short-circuited owing to the influence of the non-infinite magnetizing inductance, since the impedance of the inductance decreases.

It is desirable to reduce as far as possible the effect of the leakage inductance and stray capacitance and stray capacitance especially in the case of transformers which operate with a low impedance, where the leakage inductance becomes the major disturbing factor. However, in this case a new disturbing factor makes its appearance which arises from the length of the external connections between the pulse generator and the primary winding of the transformer. This disturbing factor is termed the connection inductance and in the equivalent-circuit diagram of the transformer it is connected in series with the leakage inductance. Its operation is, however, independent of that of the leakage inductance although it too deforms the leading edge of the pulse.

OBJECT OF THE INVENTION

An object of the present invention is to provide means which greatly reduce the effect of the leakage inductance and the connection inductance.

SUMMARY OF THE INVENTION

A pulse transformer according to my invention, inserted between a low-impedance source of high-power pulses and a high-impedance load to be energized thereby, comprises a primary winding including an outer multi-turn layer and an inner multi-turn layer in the form of peripherally slitted sheet-metal tubes surrounding a core which is also surrounded by an associated secondary winding connected across the load, these layers being substantially coextensive in length and differing from each other in the number of their turns. The two layers have first extremities which are conductively interconnected and further have opposite second extremities which are provided with separate but closely juxtaposed terminals connected across the source, the sense of winding of the layers being such that the fluxes induced by them in the core oppose each other to produce a residual flux determined by the difference between the numbers of their turns.

BRIEF DESCRIPTION OF THE DRAWING

The above and other features of my invention will now be described in detail with reference to the accompanying drawing in which.

SPECIFIC DESCRIPTION

Figure 1:
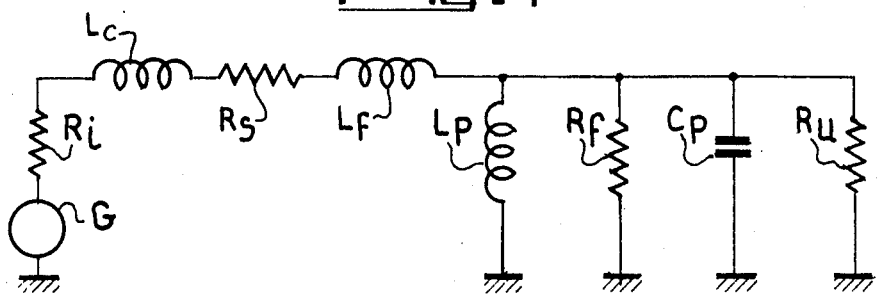
FIG. 1 is an equivalent-circuit diagram for the primary winding of a pulse transformer.

FIG. 1 shows the equivalent-circuit diagram of a very-wide-band power transformer with its parasitic impedance. This circuit diagram relates to the primary of the transformer.

The equivalent-circuit diagram includes a pulse generator G which feeds a load here represented by a resistor $R_u$. At $R_i$I have shown the internal resistance of the generator G, at $L_f$the leakage inductance of the windings of the transformer, and $L_c$ the series inductance introduced by the significant length of the connections from the transformer to the load. In parallel with load $R_u$ are the so-called magnetizing inductance $L_p$, representing the inductance of the transformer winding, and the stray capacitance $C_p$ existing between windings. Certain of these factors have a disadvantageous effect on the theoretically ideal pulses provided by generator G.

The leakage inductance $L_f$and the stray capacitance $C_p$ tend to attenuate the high frequencies to a considerable degree, thus affecting the steepness of the leading edge of the pulse. Since the magnetizing inductance is not of infinite value, the low frequencies have a tendency to be short-circuited as the magnitude of the inductance decreases with frequency.

To this must be added the effect due to energy losses in the core, which are represented by a resistor $R_f$ in parallel with the inductance $L_p$. A resistor Rs has also been shown in series with the leakage inductance $L_f$to represent the resistance losses in the windings. This resistance, however, is often negligible.

It is known that the effect of the leakage inductance $L_f$ becomes greater as the internal impedance of the equivalent generator decreases. However, when thyristors are used in modulators, this means that the internal impedance of the equivalent generator is low since thyristors operate with high current and low voltage.

Such thyristorized modulators are part of the art and will not be described here. They have however the advantage that it is possible to form modules $M_{01}$ to $M_{0n}$ (FIG. 2) in which the modulation energy is stored; the energy in all the modules, which are connected in parallel with the primary $E_p$ of the output transformer T, is summed at the moment of discharge of the associated delay lines.

Figure 2:
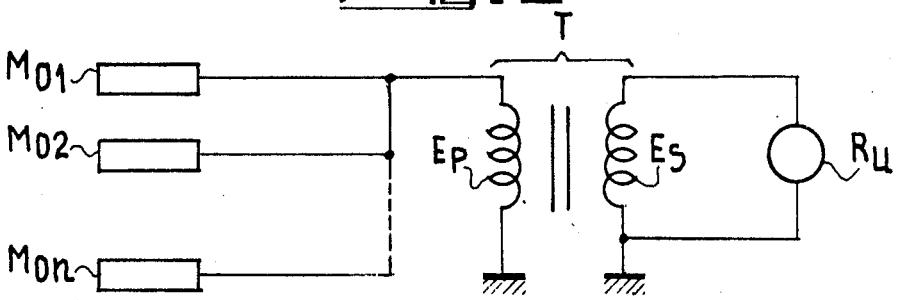
FIG. 2 is a diagrammatic representation of a number of modulator modules connected in parallel with the primary winding of the transformer.

The arrangement shown in FIG. 2 delivers to the secondary winding $E_s$ a level of output power which may be considerable. There is, however, a drawback which becomes apparent with modulators of this kind, specifically in the output transformer. In fact, if the impedance of the primary of the transformer serving all the modulators connected in parallel is relatively low, e.g. of the order of 1 to 2 ohms, where there are some 10 to 20 modules connected in parallel each of which has an impedance of the order of 25 ohms, it is necessary further to reduce the size of the parasitic factors defined above. This entails using a very small number of turns in the primary, possibly about two to three turns for short pulses, which presents a technical problem that is rather difficult to solve.

In addition, since the secondary winding $E_s$ of the transformer generally supplies a microwave tube, represented by $R_u$, it carries a high voltage and this calls for a transformer of large dimensions which are increased by the insulation required between the primary and the secondary.

In accordance with the invention, the primary of the transformer is a winding which is machined from the solid in a copper tube of rectangular cross-section.

Figure 3:
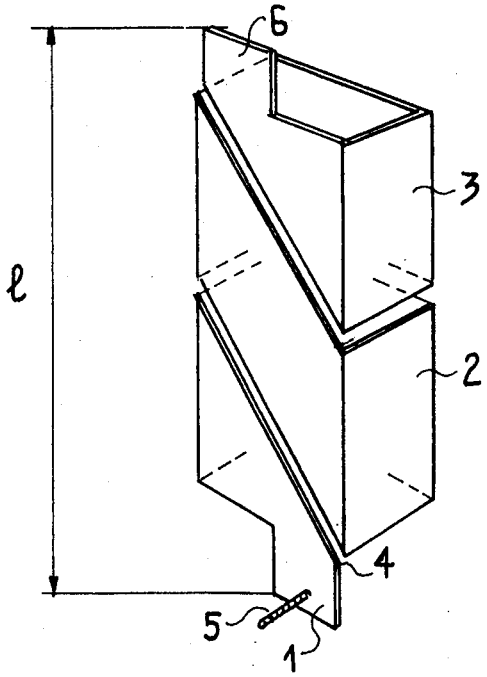
FIG. 3 is a primary winding of a transformer according to the invention.

FIG. 3 shows such a primary winding. A sheet 1 of copper is folded into prismatic shape and cut away to produce, in the example shown, two turns marked 2 and 3. The turns are separated by a slot 4 whose width is calculated to withstand the interturn voltage. The angle which the slot forms with the horizontal depends on the geometry of the winding.

It has been stated that the primary of the transformer is connected to the outputs of a number of modulating modules connected in parallel. This connection is made by means of matched coaxial cables. The result is that there is no leakage inductance since connection is contained within the coaxial structure. However, the distance between the two ends 5 and 6 of the primary winding makes it necessary to establish a connection which has the disadvantages of creating a considerable impedance discontinuity and of forming an impedance external to the transformer, i.e. the aforementioned series inductance $L_c$, which results in distortion of the leading edge of the received power pulse.

I shall now describe how, in accordance with the invention, this connection impedance is removed by effectively bringing together the terminals 5 and 6 shown in FIG. 3.

Instead of directly manufacturing a primary winding containing the required small number of turns as mentioned, this number may be considered as equal to the difference between the number of turns in two winding layers which are connected in series but which are so arranged relative to one another that the magnetic fluxes they induce in the core are opposed to each other.

Figure 4:
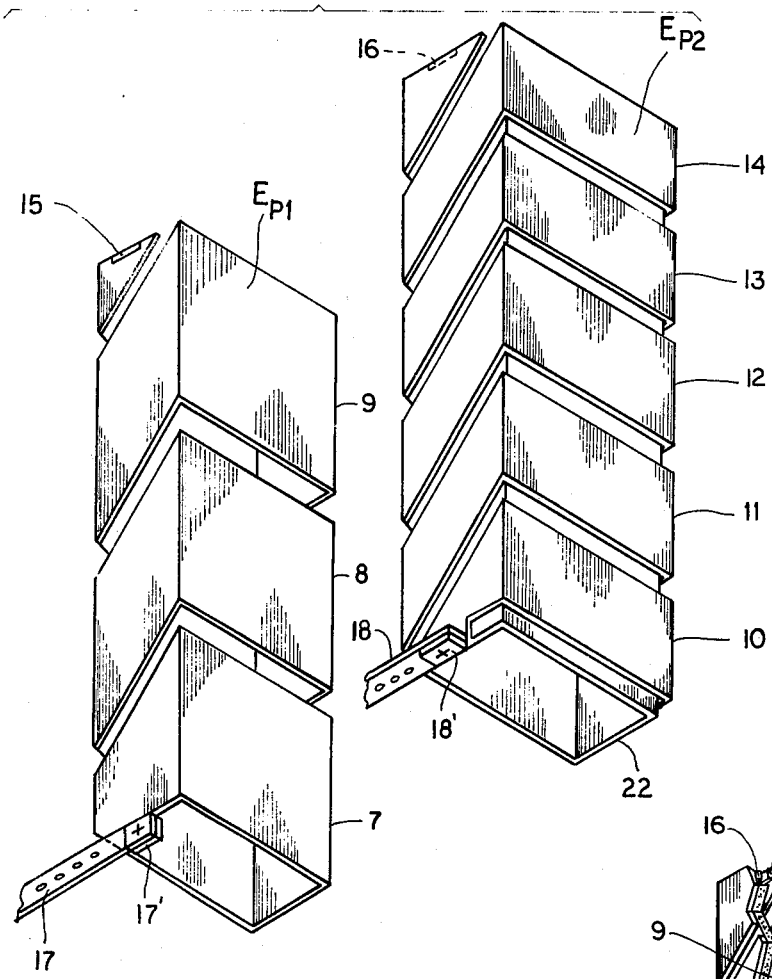
FIG. 4 is an exploded view of the whole of a primary winding of a transformer formed by two separate windings connected in series.

FIG. 4 is a diagrammatic exploded view of the way in which this primary winding produced, namely from a first winding layer $E_{p1}$ and a second winding layer $E_{p2}$ of prismatic configuration. Both these winding layers are produced in the way described with reference to FIG. 3. Winding layer $E_{p1}$ contains three turns 7, 8, 9 whereas winding layer $E_{p2}$ contains five turns 10, 11, 12, 13 and 14. These two winding layers are connected in series by soldered or welded joints at 15 and 16. At 17 and 18 I have shown two bus bars serving to join the winding layers to coaxial cables for connecting them to the parallel modulation modules $M_{01}$ to $M_{0n}$ of FIG. 2, these bars being attached to tabs 17' and 18' of the respective winding layers.

Figure 5:
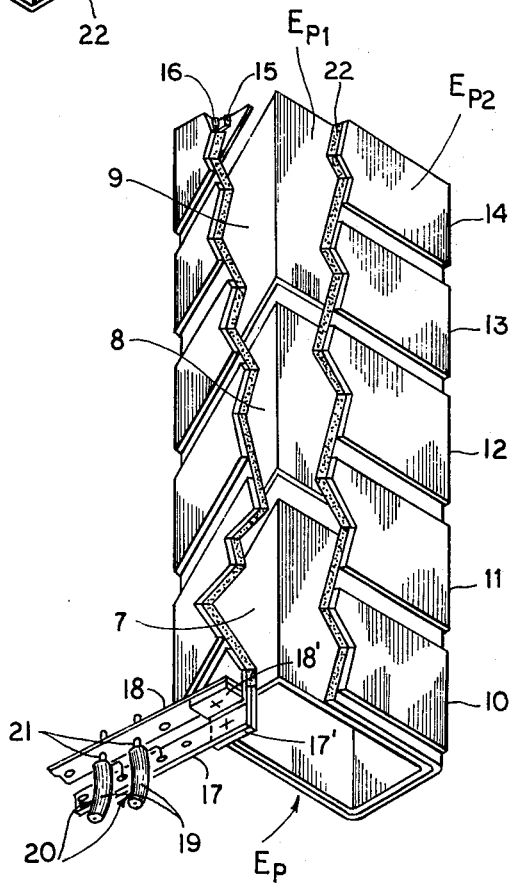
FIG. 5 is a view of the complete primary winding.

FIG. 5 is a schematic view of the complete primary winding $E_p$ of the transformer, with layer $E_{p1}$ positioned inside layer $E_{p2}$ and the two layers connected in series by welding or soldering at the joint 15, 16. Bus bar 17 may connect the three-turn winding layer $E_{p1}$ to sheaths 19, for example, of several coaxial cables 20 while bus bar 18 connects the five-turn winding layer $E_{p2}$ to the central conductors 21 of these cables. An interposed insulating layer is shown at 22. In the Figure it can be seen that the two winding layers $E_{p1}$ and $E_{p2}$ are connected in series but that the fluxes they induce are opposed to each other. The overall effect of such an arrangement is equivalent to that which would be obtained from a single-layer winding having two turns. The advantage of this arrangement according to the invention is that the so-called connection inductance disappears because the points at the top and bottom of the winding, i.e. at terminals 5 and 6 in FIG. 3, become a single point at the bottom of the winding in FIG. 5. It will also be noted that the proximity of the input and output terminals 17', 18' of the complete primary winding considerably reduces the impedance discontinuity which arises owing to the fact that there is a transition at this point from a coaxial structure to a linear structure, giving rise to parasitic reflections.

Figure 6:
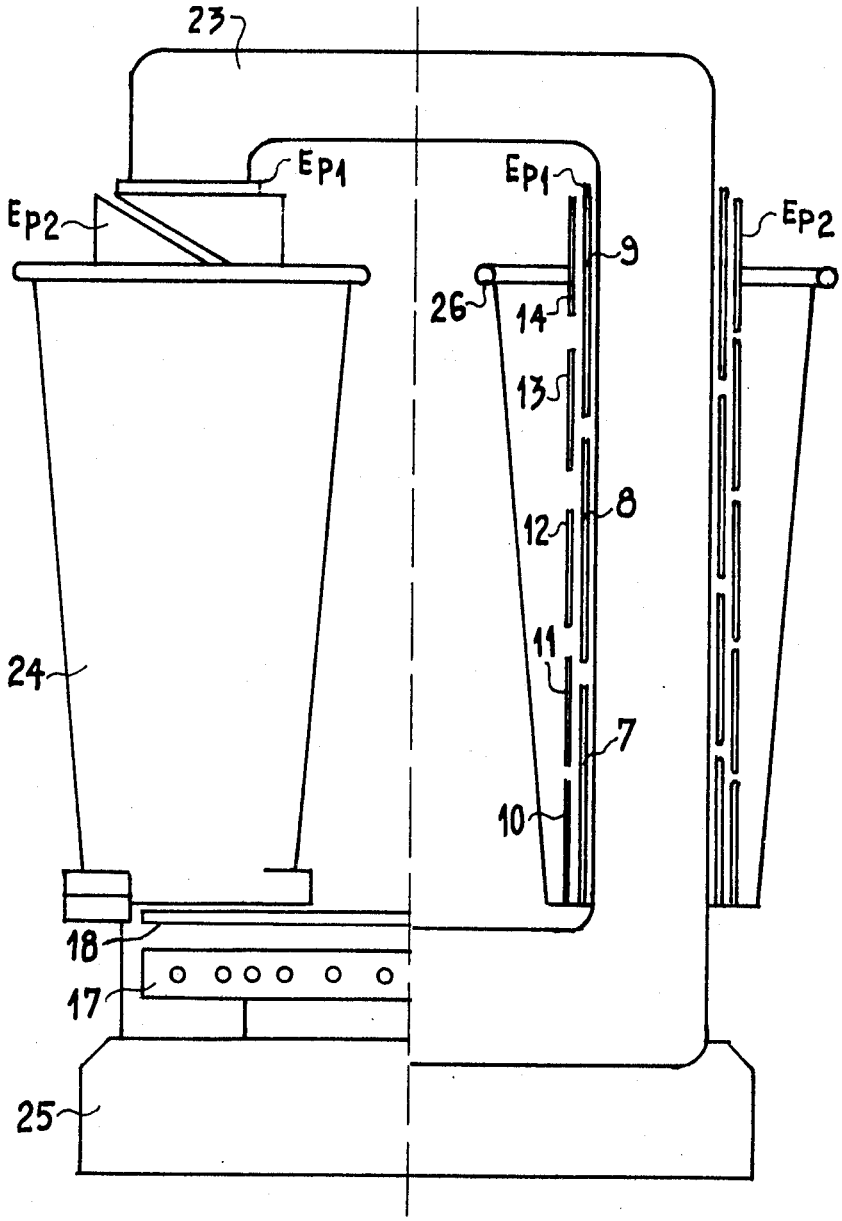
FIG. 6 is a schematic view of a transformer employing the primary windings according to the invention.

FIG. 6 is a diagram of a complete embodiment of a pulse transformer according to the invention. On the left leg of the transformer there can be seen a composite primary winding $E_{p1}$, $E_{p2}$ as shown in FIG. 4. On the right-hand leg of the transformer, which is shown in cross-section, the layers $E_{p1}$ and $E_{p2}$ can be seen more clearly, surrounding a core 23 with their three and five turns respectively marked 7–9 and 10–14 as in FIG. 5.

It will be noted that in the embodiment shown in FIG. 6, the secondary winding 24 is of downwardly tapering trapezoidal outline, with the primary and secondary windings closer together at the bottom of the transformer leg than at its top to provide a constant voltage gradient. This arrangement, under the conditions where the input impedance of the transformer is low, makes it possible to have a greatly reduced leakage inductance. The stray capacitance, however, tends to increase, but with the assembly of FIG. 6 its effects are not troublesome in view of the fact that there is no voltage difference at the bottom of the transformer leg where the primary and secondary windings are close together whereas the voltage difference is at a maximum at the top of the leg where the windings are well separated from one another.

In FIG. 6 I have also shown the bus bars 17 and 18 to which are connected the coaxial cables from the various modulating modules. The transformer has a base 25 and an anti-corona ring 26.

What is claimed is:

1. In a system for energizing a high-impedance load with high-power pulses from a low-impedance source, wherein a pulse transformer is inserted between said source and said load, the improvement wherein said transformer comprises:

a primary winding connected across said source;

a secondary winding connected across said load; and a core surrounded by said primary and secondary windings;

said primary winding including an outer multi-turn layer and an inner multi-turn layer in the form of peripherally slitted sheet-metal tubes surrounding said core and differing from each other in the number of their turns, said layers being substantially coextensive in length with conductively interconnected first extremities and with opposite second extremities provided with separate but closely juxtaposed terminal connections to said source, the sense of winding of said layers being such that the fluxes induced by them in said core oppose each other to produce a residual flux determined by the difference between the numbers of their turns.

2. The improvement defined in claim 1 wherein said outer layer has a larger number of turns than said inner layer.

3. The improvement defined in claim 2 wherein said outer and inner layers have five and three turns, respectively.

4. The improvement defined in claim 1 wherein said tubes are of prismatic configuration.

5. The improvement defined in claim 1, further comprising an insulating layer interposed between said tubes.

6. The improvement defined in claim 1 wherein said secondary winding surrounds said primary winding and tapers toward said second extremities.

7. The improvement defined in claim 1 wherein said source comprises a plurality of parallel-connected modulator modules with coaxial output cables, said terminal connections including a pair of conductor bars connected in parallel across said cables.

* * * * *